US008641109B2

(12) United States Patent
Ng

(10) Patent No.: US 8,641,109 B2
(45) Date of Patent: Feb. 4, 2014

(54) PET SHOVEL

(76) Inventor: John Ng, Aurora, CO (US)

( * ) Notice: Subject to any disclaimer, the term of this patent is extended or adjusted under 35 U.S.C. 154(b) by 0 days.

(21) Appl. No.: 13/428,278

(22) Filed: Mar. 23, 2012

(65) Prior Publication Data

US 2013/0249224 A1 Sep. 26, 2013

(51) Int. Cl.
*A01K 29/00* (2006.01)

(52) U.S. Cl.
USPC ..... 294/1.4; 294/1.5

(58) Field of Classification Search
USPC ..... 294/1.3–1.5, 49, 209, 210, 53.5, 176, 9; 119/161, 867; 15/257.1, 257.3, 104.8; 248/95, 99; 383/105
See application file for complete search history.

(56) References Cited

U.S. PATENT DOCUMENTS

| | | | | |
|---|---|---|---|---|
| 4,447,082 | A * | 5/1984 | Lindholm | 294/1.4 |
| 4,477,111 | A | 10/1984 | Crooks | |
| 4,958,871 | A | 9/1990 | Hemans | |
| 5,820,179 | A * | 10/1998 | Tsou | 294/1.4 |
| 6,062,168 | A | 5/2000 | Host et al. | |
| 6,135,520 | A | 10/2000 | Miller et al. | |
| 6,237,972 | B1 | 5/2001 | Jung | |
| 6,485,073 | B2 | 11/2002 | Harrison | |
| 7,040,677 | B1 | 5/2006 | Wickser, Jr. | |
| 7,188,878 | B1 | 3/2007 | Kraus | |
| 7,665,489 | B1 * | 2/2010 | Smith | 141/108 |
| 7,686,361 | B1 | 3/2010 | Finn | |
| 8,038,190 | B2 | 10/2011 | Zidulka et al. | |
| 2002/0185874 | A1 * | 12/2002 | Arceo | 294/1.4 |
| 2004/0164568 | A1 * | 8/2004 | Diehl | 294/1.4 |
| 2005/0184540 | A1 * | 8/2005 | Graziosi | 294/1.4 |
| 2010/0072765 | A1 * | 3/2010 | Granado | 294/1.4 |
| 2011/0057463 | A1 * | 3/2011 | Chen | 294/1.4 |

* cited by examiner

*Primary Examiner* — Stephen Vu
(74) *Attorney, Agent, or Firm* — Mahurin IP Law, LLC; Jerry L. Mahurin

(57) ABSTRACT

A pet shovel has an elongated handle, a shovel head and a bag mounting frame disposed between the shovel head and a distal end of the elongated handle. The frame forms an opening between the shovel head and the distal end of the elongated handle. The bag mounting frame is adapted to retain a mouth of a bag open disposed between the shovel head and the distal end of the elongated handle in the opening between the shovel head and the distal end of the elongated handle. A bag body support extends from a bottom of the elongated handle to receive a body of the bag mounted on the bag mounting frame to form a sump in an end of the bag, distal from the shovel head and the mouth of the bag.

15 Claims, 8 Drawing Sheets

PET SHOVEL

BACKGROUND OF THE INVENTION

1. Field of the Invention

This invention relates generally to shovels and the like, more particularly to shovels for handling pet waste, and specifically to a pet shovel mounting a pet waste disposal bag.

2. Description of the Prior Art

To avoid contact with pet waste when cleaning up after a pet, such as a dog, one of several methods are typically employed. For example, the person cleaning up the waste may place an inside-out plastic bag over their hand, pick-up the wastes and then turn the bag right-side-out to capture the waste in the bag.

When cleaning up an area such as a yard or dog pen typical solutions might involve the use of a shovel or scoop to pickup the waste for disposal into a bag (e.g. a garbage bag) held by a second person or into a garbage bag disposed in a trashcan or the like. Alternative methods for cleaning up such an area (or after a dog being walked) may include a two-tool system, such as a scoop disposed generally perpendicularly on an elongated handle and a cooperating dustpan sort of tool disposed on the end of a second elongated handle. Other existing tools for cleaning up after a pet include pincher type tools disposed on the end of an elongated handle. U.S. Pat. Nos. 4,477,111 and 6,062,168 are exemplary of various grabber/clamshell devices, using a bag therewith.

Various scoops or shovels having means for mounting a waste disposal bag of some sort are also proffered as means for cleaning up after pets. For example, U.S. Pat. No. 4,958,887 is an example of a scooper-type arrangement that uses a bag. U.S. Pat. No. 6,237,972 shows a tubular scooper that employs a bag. U.S. Pat. No. 7,188,878 also shows a scooper-type arrangement that uses a bag, but with a clamp disposed on the handle to receive the handles of a shopping bag or the like. U.S. Pat. No. 6,485,073 is directed to an animal refuse shovel with a bag mounted on a frame-like scoop. Finally, U.S. Pat. No. 8,038,190 is directed to a frame-like shovel head mounting a bag over the shovel head, wherein the bag can be rotated to maintain the scooped waste.

SUMMARY

The present invention is directed to systems and methods, which in various embodiments, provide a pet shovel having an elongated handle and a shovel head with a bag mounting frame or rim disposed between the shovel head and a distal end of the elongated handle. This frame forms an opening between the shovel head and the distal end of the elongated handle. This bag mounting frame may be adapted to retain the mouth of a bag, such as a garbage bag, to hold the mouth of the bag open, disposed between the shovel head and the distal end of the elongated handle in the aforementioned opening defined by the frame between the shovel head and the distal end of the elongated handle. In accordance with various embodiments, a bag body support extends from the elongated handle, such that this bag body support may receive a body of a bag mounted on the bag mounting frame so as to form a sump in an end of the bag, distal from the shovel head and the mouth of the bag mounted in the bag mounting frame. The bag body support may, in accordance with various embodiments be slideably disposed along/from the elongated handle. For example, a sleeve may be adjustably disposed to selectively slide along the elongated handle, with the bag body support extending downwardly from the sleeve.

In accordance with some embodiments the elongated handle and the bag mounting frame may be hinged to one another, allowing the shovel head and the bag mounting frame to fold against the elongated handle. Alternatively, in accordance with other embodiments the shovel head and the bag mounting frame may be hinged to one another, allowing the shovel head to fold against the bag mounting frame.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

The accompanying drawings, which are incorporated in and form part of the specification in which like numerals designate like parts, illustrate embodiments of the present invention and together with the description, serve to explain the principles of the invention. In the drawings.

DETAILED DESCRIPTION

Figure 1:
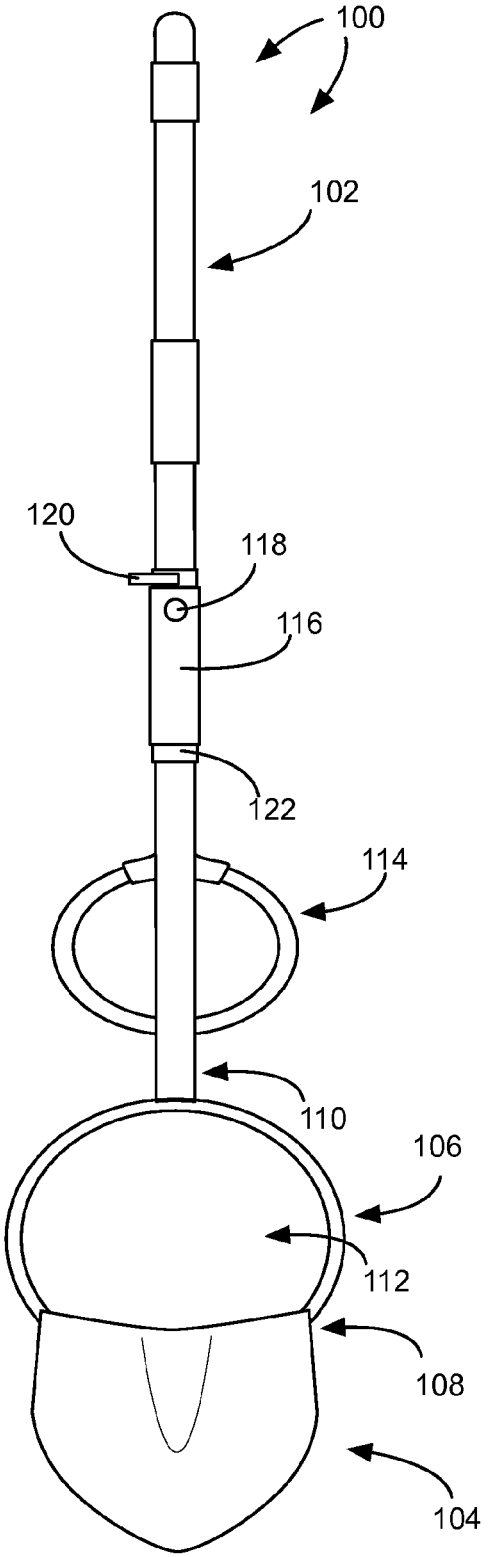
FIG. 1 is a front view of one embodiment of the present pet shovel.
Figure 2:
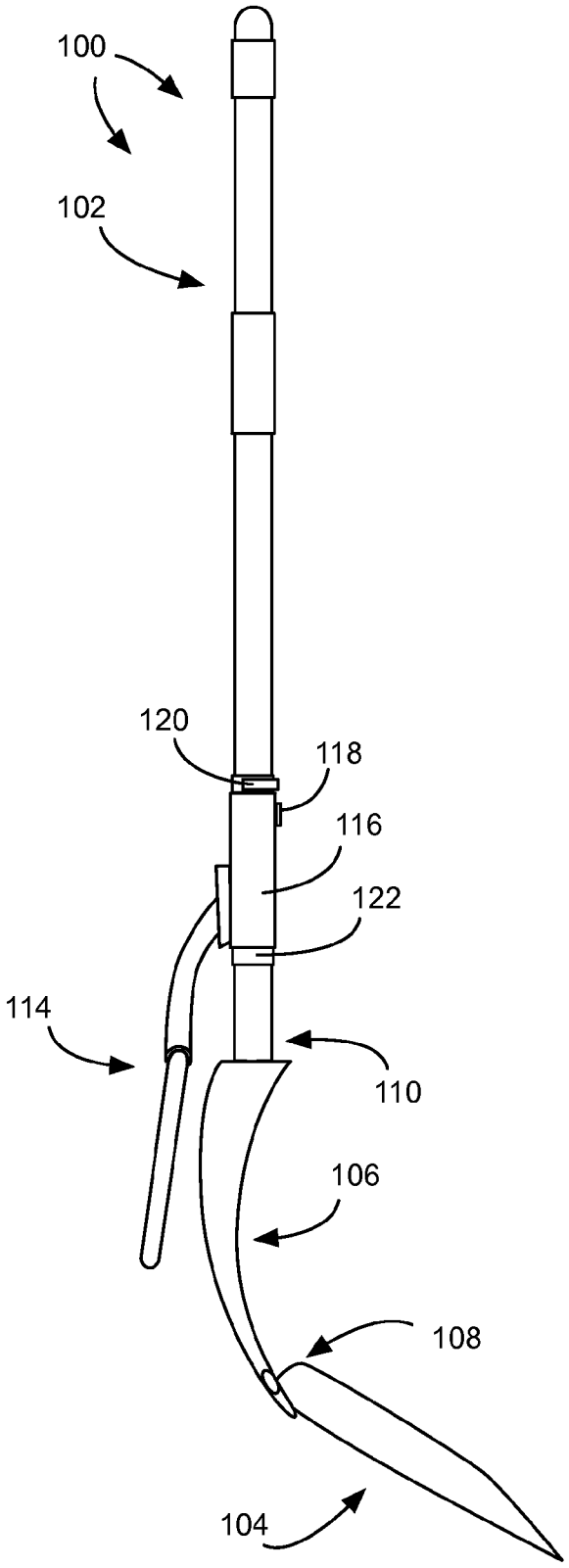
FIG. 2 is a side view of the pet shovel embodiment shown in FIG. 1, wherein the bag body support is shown in a moved position.
Figure 3:
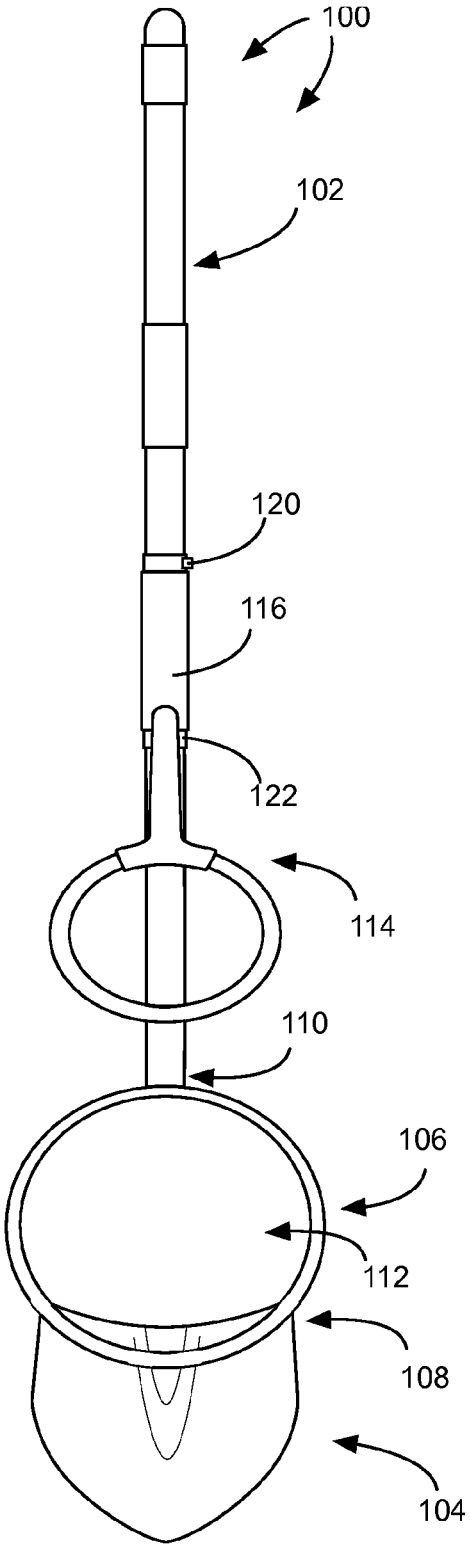
FIG. 3 is a rear view of the pet shovel embodiment shown in FIGS. 1 and 2.

FIG. 1 is a front view of one embodiment of pet shovel 100, while FIG. 2 is a side view of the embodiment of pet shovel 100 shown in FIG. 1, and FIG. 3 is a rear view of the embodiment of pet shovel 100 shown in FIGS. 1 and 2. In such an embodiment, pet shovel 100 has elongated handle 102 and shovel head 104, with bag mounting frame 106 disposed therebetween. Specifically, as seen in FIGS. 1-3, frame 106 extends from proximal portion 108 of shovel head 104 to distal end 110 of elongated handle 102. Frame 106 defines bag receptive opening 112 between shovel head 104 and distal end 110 of elongated handle 102. Elongated handle 102 may be extensible and/or retractable, and may be locked at a particular length.

In accordance with various embodiments, bag body support 114, such as the illustrated hoop, extends from elongated handle 102. FIG. 2 is a side view of pet shovel 100, wherein the bag body support is shown in a moved position. In accordance with some embodiments, bag body support 114 may, be slideably disposed along/from elongated handle 102. For example, sleeve 116 may be adjustably disposed to selectively slide along elongated handle 102, with bag body support 114 extending from sleeve 116.

Figure 4:
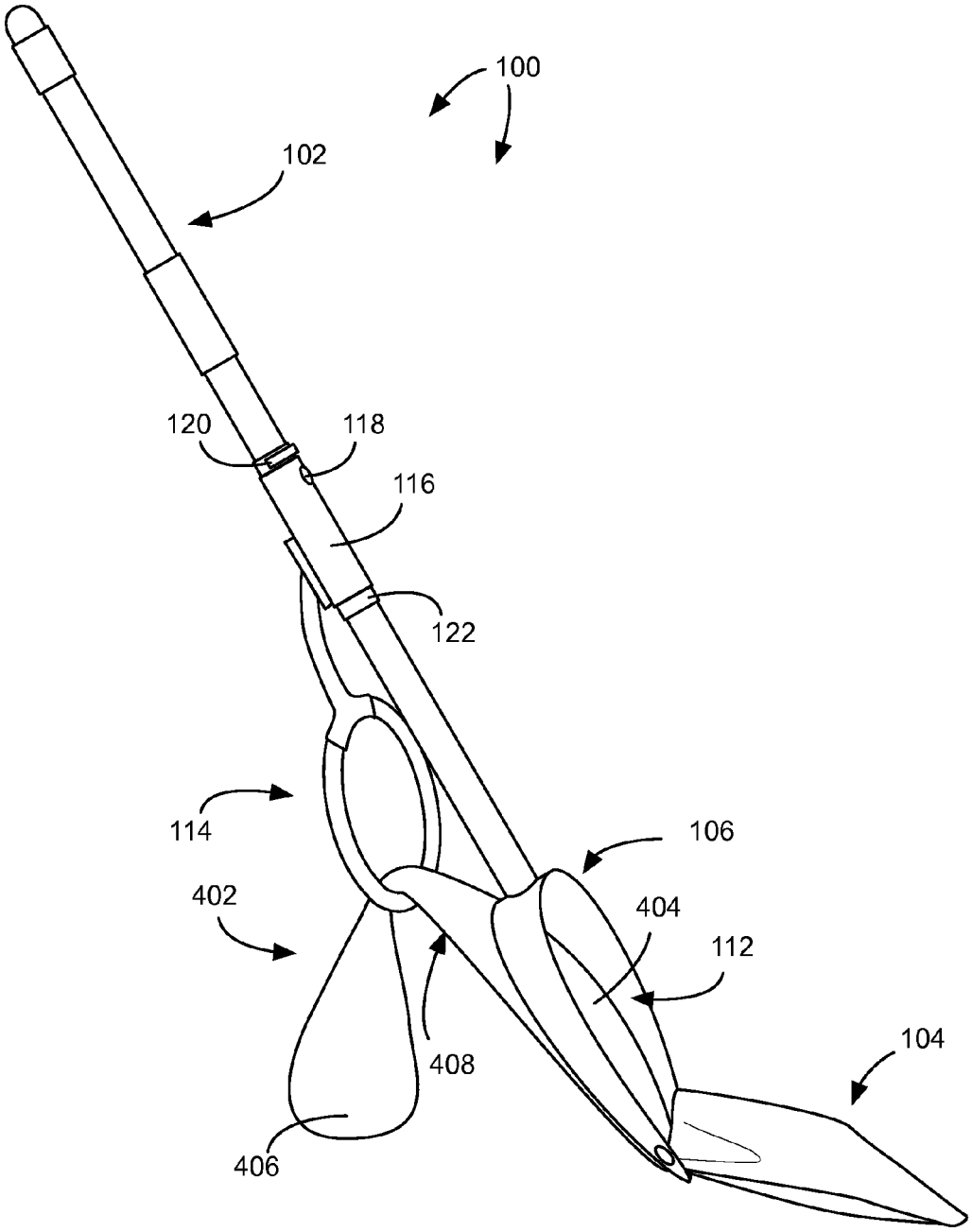
FIG. 4 is a perspective view of an embodiment of the present pet shovel, showing a pet refuse bag installed on the frame between the shovel head and handle and disposed over the support to form a pet waste sump.

FIG. 4 is a perspective view of an embodiment of pet shovel 100, showing bag 402 installed on frame 106, between shovel head 104 and distal end 110 of handle 102. In accordance with such embodiments, bag mounting frame 106 may be a rim or the like, adapted to retain mouth 404 of bag 402, such as a garbage bag, so as to hold mouth 404 of bag 402 open, disposed between shovel head 104 and distal end 110 of elongated handle 102 in aforementioned frame opening 112. Further, FIG. 4 shows garbage bag 402 disposed over support 114 to form pet waste sump 406. As noted above, bag body support 114 extends from elongated handle 102, such that this bag body support may receive body 408 of bag 402 mounted on bag mounting frame 106 so as to form sump 406 in end 410 of bag 402 during use, distal from shovel head 104 and the mouth of bag 402. In accordance with various embodiments, bag body support 114 may be slideably disposed along/from the elongated handle. For example, in FIG. 4 sleeve 116, from which support 114 extends, may be adapted to selectively slide along the elongated handle 102. In accordance with particular embodiments sleeve 116 may lock in place. For instance, one or more buttons 118, levers 120, collars 122, or the like may be pushed, moved, twisted or otherwise actuated to activate a locking mechanism to hold sleeve 116 in place along handle 102, such as through friction, clamping, mechanical indexing of sleeve and handle components, or the like.

Thus, in operation, a mouth of a pet refuse bag, such as mouth 404 of garbage bag 402 is secured on frame 106, disposed between shovel head 104 and distal end 110 of elongated handle 102 of pet shovel 100. Body 408 of pet refuse bag 402 is extended through bag body support 114, forming pet refuse sump 406 in an end of pet refuse bag 402, distal from mouth 404 of pet refuse bag 402 and shovel head 104. Support 114 may be slid along elongated handle 102 and locked in place to adjust the size, position and/or shape of pet refuse sump 406, to accommodate pet refuse bags of different sizes, and/or to facilitate installation and/or removal of pet refuse bag 402 from pet shovel 100. As noted, FIG. 2 shows support 114 slid into a moved position, more-or-less in alignment with frame 106, which may facilitate installation and/or removal of pet refuse bag 402.

During use, pet refuse is scooped onto shovel head 104 and pet shovel 100 is tilted back to move the pet refuse through mouth 404 of pet refuse bag 402 and into pet refuse sump 406. The pet refuse is retained in sump 406 while further pet refuse is scooped and pet shovel 100 is tilted back to move this additional pet refuse into pet refuse sump 406.

Figure 5:
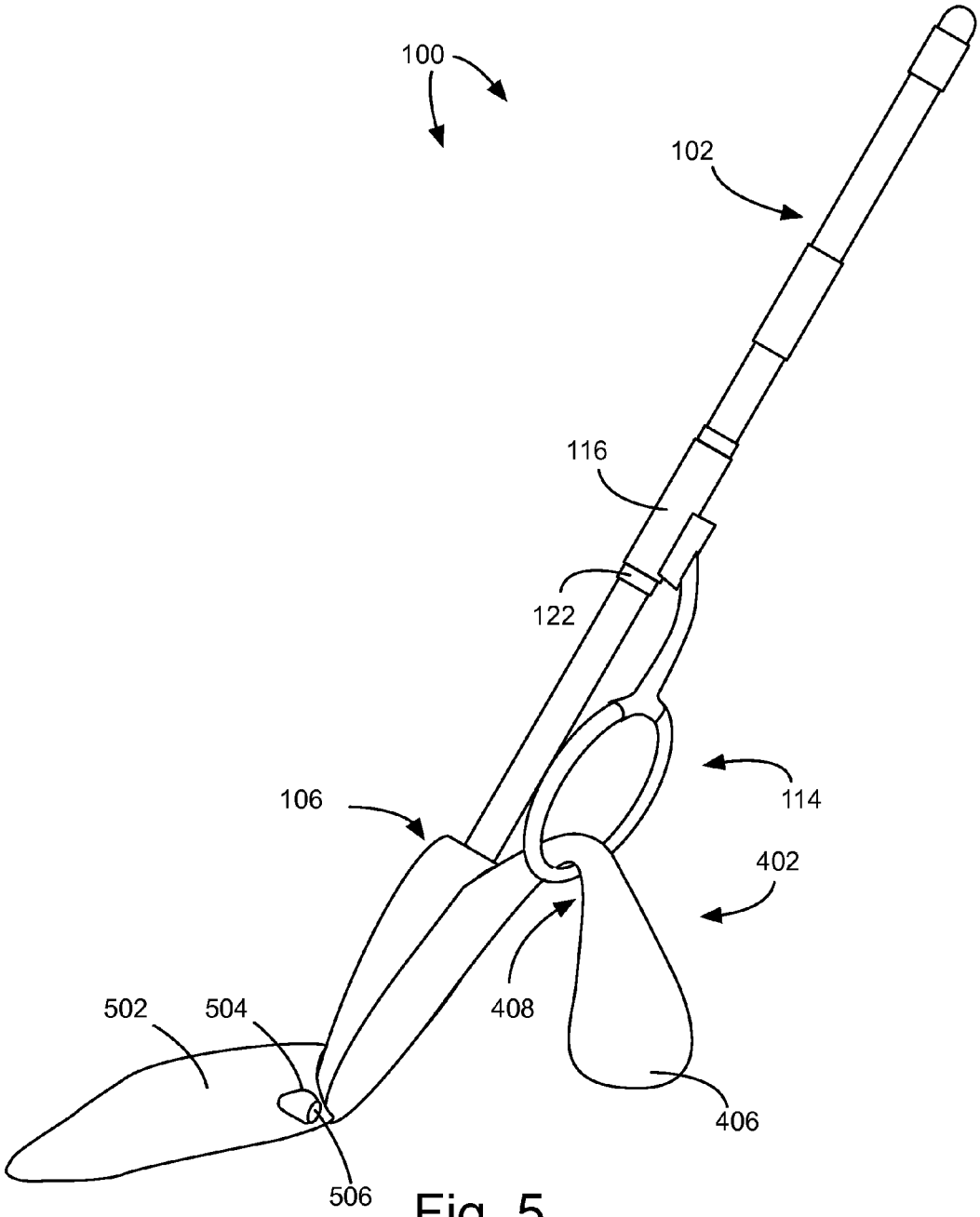
FIG. 5 is a perspective view of an embodiment of the present pet shovel, showing a pet refuse bag installed on the frame between the shovel head and handle and disposed over the support to form a pet waste sump and a second bag disposed over the shovel head.

Additionally, a second bag may be disposed over shovel head 104 to help keep shovel head 104 clean when scooping pet waste. FIG. 5 is a perspective view of an embodiment of present pet shovel 100, showing both garbage bag 402 installed on frame 106 between shovel head 104 and distal end 110 of handle 102 and disposed over support 114 to form pet waste sump 406, and shopping bag 502, or the like, disposed over shovel head 104. In accordance with various embodiments, handles 504 of plastic shopping bag 502 may be hooked over tabs 506 disposed on back corners of shovel head 104 (and/or on a lower portion of frame 106, such as near back corners of shovel head 104) such as shown in FIG. 5.

Figure 6:
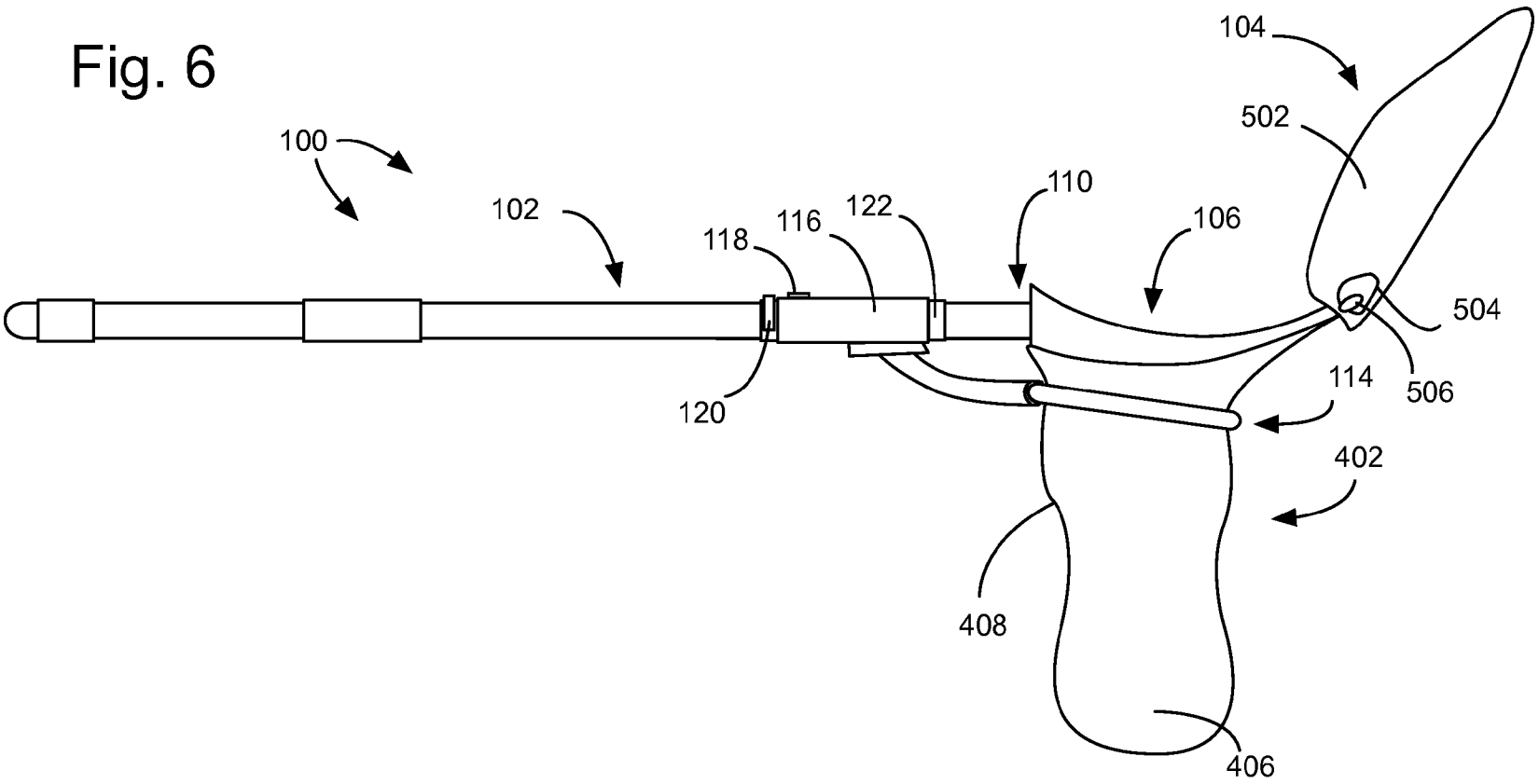
FIG. 6 is a side view of an embodiment of the present shovel, wherein the shovel is tilted back and the bag body support is shown in a moved position in preparation for removal of the pet refuse bag.

Removal of pet refuse bag 402 may be facilitated by movement of support 114. For example, FIG. 6 is a side view of an embodiment of present shovel 100, wherein shovel 100 is tilted back and bag body support 114 is shown in a moved position, more-or-less in alignment with frame 106, in preparation for removal of pet refuse bag 402. If a shopping bag or the like (502) is installed over shovel head 104, it may first be removed by freeing shopping bag handles 504 from tabs 506 and the shopping bag may be paced into pet refuse bag 402, through mouth 404 of pet refuse bag 402 before removal of pet refuse bag 402. With support 114 disposed more-or-less in alignment with frame 106, and shovel 100 tilted back, as shown in FIG. 6, pet refuse bag 402 is disposed in a position to receive a removed shovel head cover bag 502 and to be closed, either before removal from frame 106, such as through the use of a twist tie or the like around bag body 408, or following removal from frame 106.

Figure 7:
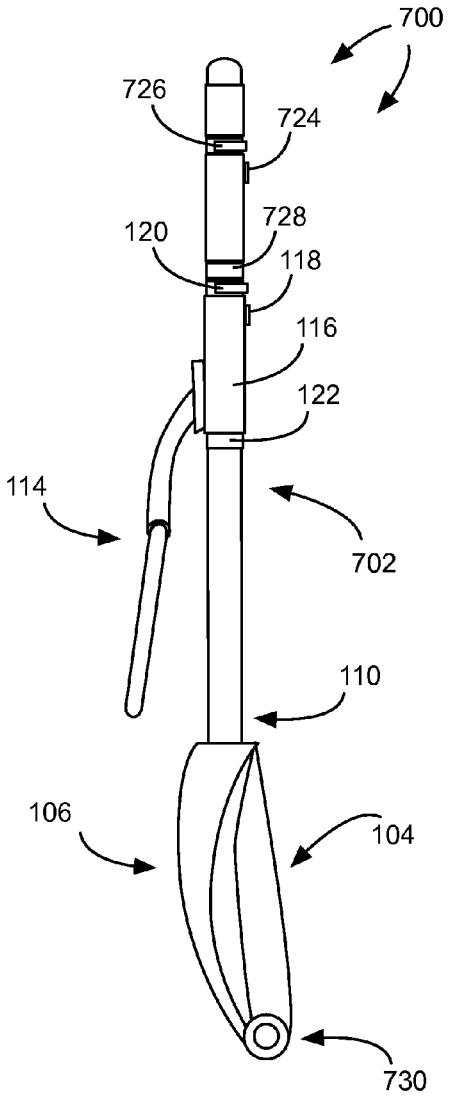
FIG. 7 is a side view of one embodiment of the present pet shovel showing the shovel head folded against the frame and the elongated handle collapsed.

FIG. 7 is a side view of one embodiment (700) of present pet shovel showing the shovel head folded against the frame and a distal end of the handle. In accordance with some embodiments the elongated handle and the bag mounting frame may be hinged to one another, allowing the shovel head and the bag mounting frame to fold against the elongated handle, such as about hinge 730, or the like. Alternatively, in accordance with other embodiments (800), the shovel head and the bag mounting frame may be hinged to one another, such as about hinge 830, allowing the shovel head to fold against the bag mounting frame and the distal end of elongated handle. To wit, FIG. 8 is a perspective/side view of embodiment 800 of the present pet shovel showing the shovel head and frame folded against the distal end of the handle.

Figure 8:
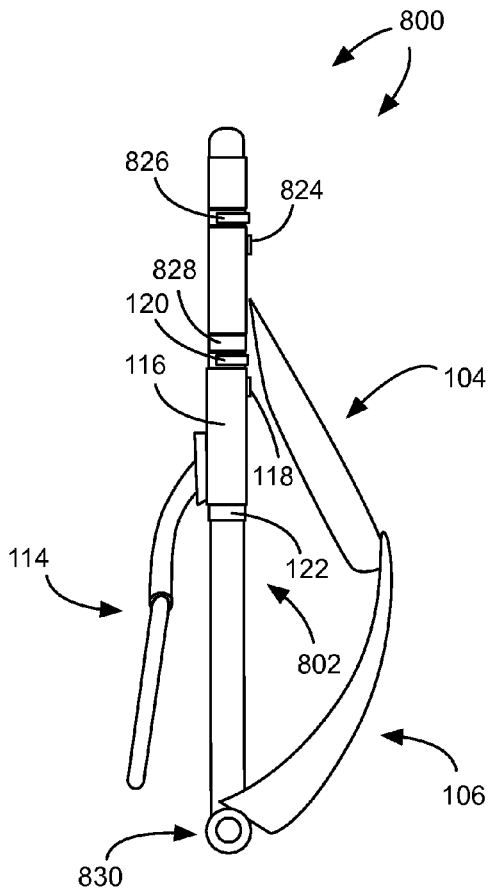
FIG. 8 is a perspective/side view of one embodiment of the present pet shovel showing the shovel head and frame folded against the distal end of the handle and the elongated handle collapsed.

Also in FIGS. 7 and 8, pet shovel embodiments 700 and 800 are shown with elongated handle 102/702/802 collapsed, as noted above, elongated handle 102 may be extensible, and may be locked at a particular length. For instance, one or more buttons 724/824, levers 726/826, collars 728/828, or the like may be pushed, moved or twisted to activate a locking mechanism to maintain elongated handle 102/702/802 at a desired length and/or to collapse handle 102/702/802 for storage, such as shown in FIGS. 7 and 8. Such buttons, levers, collars, or the like for locking handle 102/702/802 may function through friction, mechanical indexing of sleeve and handle components, and/or the like, or alternatively through a clamping action such as may be actuated and/or disengaged using lever(s) 726/826.

Figure 9:
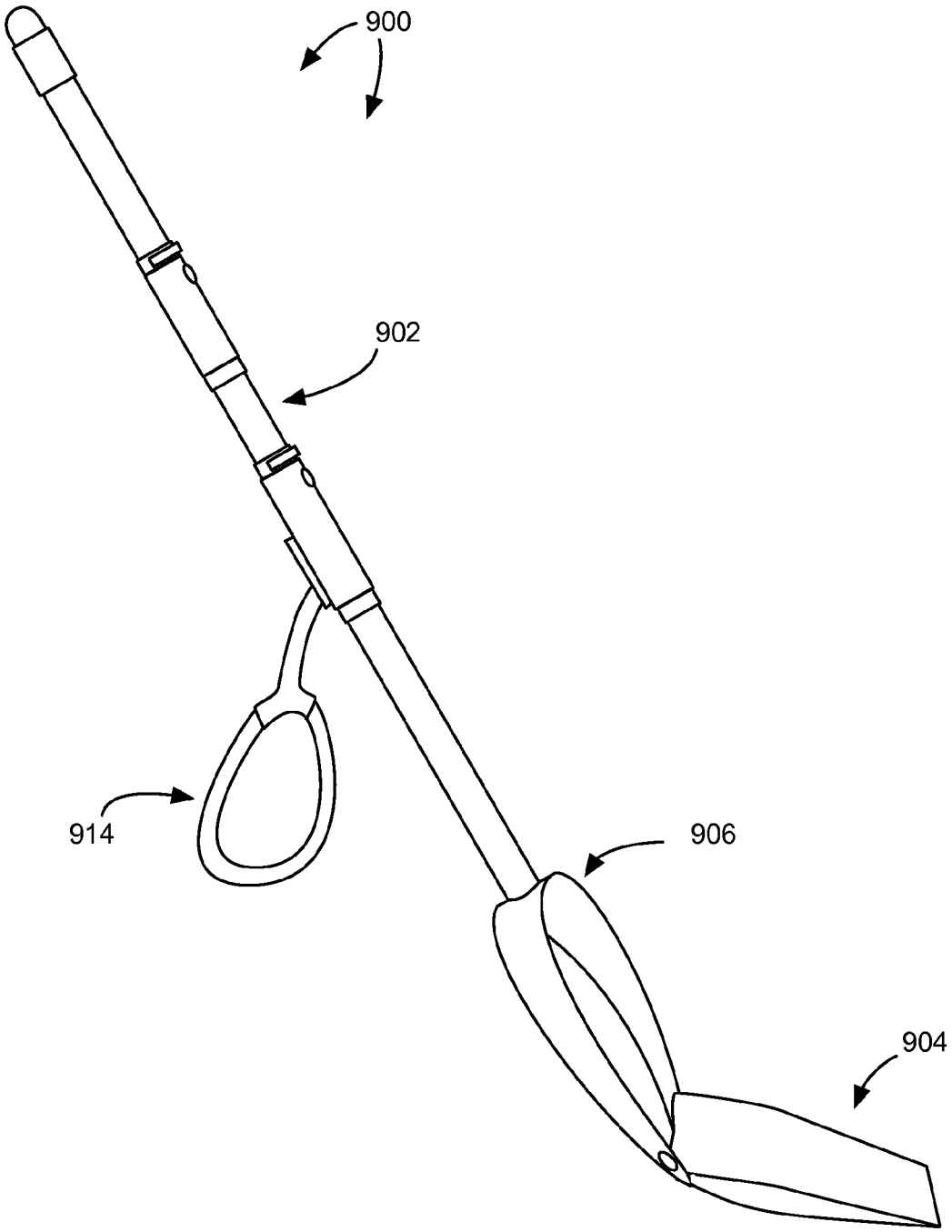
FIG. 9 is a perspective view of one alternative embodiment of the present pet shovel.

Although the present pet shovel has been described in language specific to structural features and/or methodological operations or actions, it is understood that the implementations defined in the appended claims are not necessarily limited to the specific features or actions described. Rather, the specific features and operations are disclosed as exemplary forms of implementing the claimed subject matter. For example, FIG. 9 is a perspective view of one alternative embodiment 900 of the present pet shovel, showing various alternative elements, one or more of which may be employed in different embodiments of the present pet shovel. For example, as shown in FIGS. 1 through 8 shovel head 104 may be a spaded. However, as shown in FIG. 9, shovel head 904 may have a square blade. Various other elements may differ in various embodiments. For example, frame 106/906, although shown as being generally circular may have any practical shape, such as generally square, trapezoidal, oval, etc. Similarly, bag body support 114/914 may have any number of shapes. As shown in FIG. 9, support 914 may be flat bottomed in certain embodiments. Such a configuration of support 914 may facilitate moving wastes from shovel head 904 into the sump in a mounted garage bag. Further, the bag body support may be disposed at any number of angles such as an angle, nearly parallel, to the elongated handle such as shown in FIGS. 1-8, or at an angle more perpendicular to the elongated handle, such as a shown in support 906 in FIG. 9, or even generally perpendicular to handle 902.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A pet shovel comprising:

an elongated handle;

a shovel head;

a frame disposed between said shovel head and a distal end of said elongated handle, said frame forming an opening between said shovel head and said distal end of said elongated handle;

a support extending from said elongated handle, spaced apart from said frame and slideably disposed along said elongated handle; and a bag retained on said frame, said support receiving a body of the bag to form a sump in an end of said bag, distal from said shovel head and a mouth of said bag retained open in said bag mounting frame.

2. The pet shovel of claim 1, further comprising a sleeve adjustably disposed to selectively slide along said elongated handle, said support extending from said sleeve.

3. The pet shovel of claim 1, wherein said frame is adapted to retain said mouth of said bag to hold said mouth of said bag open, disposed between said shovel head and said distal end of said elongated handle, in said opening between said shovel head and said distal end of said elongated handle.

4. The pet shovel of claim 3, further comprising a second bag retained over said shovel head.

5. The pet shovel of claim 1, wherein said bag is a garbage bag.

6. The pet shovel of claim 1, wherein said elongated handle and said frame are hinged to one another, allowing said shovel head and said frame to fold against said elongated handle.

7. The pet shovel of claim 1, wherein said shovel head and said frame are hinged to one another, allowing said shovel head to fold against said frame.

8. A method comprising:

securing a mouth of a pet refuse bag on a frame disposed between a shovel head and an elongated handle of a pet shovel;

extending a body of said pet refuse bag through a bag body support extending from said elongated handle, forming a pet refuse sump in an end of said pet refuse bag, distal from said mouth of said pet refuse bag and said shovel head; and selectively sliding said support along said elongated handle to adjust one or more of a size, position or shape of said pet refuse sump.

9. The method of claim 8, further comprising:

scooping pet refuse onto said shovel head;

tilting said pet shovel back, moving said pet refuse through said mouth of said pet refuse bag and into said pet refuse sump; and retaining, said pet refuse in said sump while scooping further pet refuse and tilting said pet shovel back to move said further pet refuse into said pet refuse sump.

10. A pet shovel comprising:

an elongated handle;

a shovel head;

a bag mounting frame disposed between said shovel head and a distal end of said elongated handle, said frame forming an opening between said shovel head and said distal end of said elongated handle, said bag mounting frame adapted to retain a mouth of a bag open disposed between said shovel head and said distal end of said elongated handle in said opening between said shovel head and said distal end of said elongated handle; and a bag body support extending from a bottom of said elongated handle to receive a body of said bag mounted on said bag mounting frame to form a sump in an end of said bag, distal from said shovel head and said mouth of said bag, said support slideable along said elongated handle to adjust one or more of a size, position or shape of said sump.

11. The pet shovel of claim 10, further comprising a sleeve adjustably disposed to selectively slide along said elongated handle, said bag body support extending from said sleeve.

12. The pet shovel of claim 10, wherein said bag is a garbage bag.

13. The pet shovel of claim 10, further comprising a second bag retained over said shovel head.

14. The pet shovel of claim 10, wherein said elongated handle is collapsible, and said handle and said bag mounting frame are hinged to one another, allowing said shovel head and said bag mounting frame to fold against said elongated handle.

15. The pet shovel of claim 10, wherein said elongated handle is collapsible, and wherein said shovel head and said bag mounting frame are hinged to one another, allowing said shovel head to fold against said bag mounting frame.

* * * * *